US011398176B2

(12) United States Patent
Kim et al.

(10) Patent No.: US 11,398,176 B2
(45) Date of Patent: Jul. 26, 2022

(54) MURA COMPENSATION DATA GENERATION APPARATUS FOR MURA COMPENSATION, AND MURA COMPENSATION APPARATUS OF DISPLAY USING MURA COMPENSATION DATA

(71) Applicant: LX Semicon Co., Ltd., Daejeon (KR)

(72) Inventors: Do Yeon Kim, Daejeon (KR); Jun Young Park, Daejeon (KR); Min Ji Lee, Daejeon (KR); Gang Won Lee, Daejeon (KR); Young Kyun Kim, Daejeon (KR); Ji Won Lee, Daejeon (KR)

(73) Assignee: LX Semicon Co., Ltd., Daejeon (KR)

( * ) Notice: Subject to any disclaimer, the term of this patent is extended or adjusted under 35 U.S.C. 154(b) by 0 days.

(21) Appl. No.: 17/643,010

(22) Filed: Dec. 7, 2021

(65) Prior Publication Data

US 2022/0180788 A1 Jun. 9, 2022

(30) Foreign Application Priority Data

Dec. 8, 2020 (KR) ..... 10-2020-0170694

(51) Int. Cl.
*G09G 3/20* (2006.01)

(52) U.S. Cl.
CPC ..... *G09G 3/20* (2013.01); *G09G 2310/027* (2013.01); *G09G 2320/0247* (2013.01)

(58) Field of Classification Search
CPC ..... G09G 3/20; G09G 2310/027; G09G 2320/0247
See application file for complete search history.

(56) References Cited

U.S. PATENT DOCUMENTS

2020/0184873 A1* 6/2020 Zheng ..... G11C 19/184
2020/0184876 A1* 6/2020 Yamauchi ..... G09G 3/2007

FOREIGN PATENT DOCUMENTS

JP 2019-531510 A 10/2019
KR 2001-0099671 A 9/2011
KR 2014-0086619 A 7/2014
KR 2015-0051437 A 5/2015

* cited by examiner

*Primary Examiner* — Sejoon Ahn
(74) *Attorney, Agent, or Firm* — Polsinelli PC

(57) ABSTRACT

A Mura compensation data generation apparatus for compensating for Mura, and a Mura compensation apparatus of a display using Mura compensation data. The Mura compensation data generation apparatus includes an image representative value generation circuit configured to generate a representative value representing an entire gray of an image; a difference value extraction circuit configured to extract difference values between the representative value and gray values for a plurality of preset positions on the image; a distribution range determination circuit configured to determine a distribution range of the difference values by checking a maximum value and a minimum value of the difference values; and a Mura compensation data generation circuit configured to generate Mura compensation data having a preset number of bits corresponding to the difference values.

11 Claims, 5 Drawing Sheets

MURA COMPENSATION DATA GENERATION APPARATUS FOR MURA COMPENSATION, AND MURA COMPENSATION APPARATUS OF DISPLAY USING MURA COMPENSATION DATA

BACKGROUND

1. Technical Field

Various embodiments generally relate to Mura compensation, and more particularly, to a Mura compensation data generation apparatus for Mura compensation of a display image and a Mura compensation apparatus of a display using Mura compensation data.

2. Related Art

Recently, LCD panels or OLED panels have been widely used as display panels.

Mura may occur in a display panel due to an error in a manufacturing process, or the like. Mura means that a partial area of a display image has non-uniform luminance in the form of a stain. A defect of a display panel in which Mura occurs is referred to as a Mura defect.

The Mura defect needs to be compensated for in order for the display panel to have improved image quality, and compensating for the Mura defect is referred to as Mura compensation.

For Mura compensation, it is necessary to secure Mura compensation data.

In order to generate the Mura compensation data, display data for each gray may be provided to the display panel, and an image displayed on the display panel may be photographed or sensed.

The Mura compensation data may be generated to correspond to difference values between a representative value and gray values of respective positions on the image secured as described above, and may be used for Mura compensation.

An algorithm for Mura compensation using the Mura compensation data may be variously selected, and Mura compensation may be performed by the selected algorithm.

For example, an algorithm of a piecewise interpolation scheme may be used for Mura compensation.

In the piecewise interpolation scheme, difference values for generating the Mura compensation data may be distributed at the same interval or different intervals in each display panel or each gray.

Calculated difference values may be expressed as the Mura compensation data having a preset number of bits. The difference values may be distributed within a range that may be expressed by a number of bits allocated for the Mura compensation data.

Each of the difference values may have an integer part and a decimal part, and the entirety or a part of the decimal part may be lost in the process of storing each of the difference values as the Mura compensation data. The loss of each of the difference values may be caused due to not expressing and rounding the decimal part in the Mura compensation data or due to limiting the decimal part to a preset limited number of places in the Mura compensation data.

The Mura compensation data in which the entirety or a part of the decimal part of each of the difference values is lost may be stored, and the stored Mura compensation data may be used in decoding for Mura compensation. Thus, when Mura compensation is performed in the piecewise interpolation scheme, a compensation error may be caused by a value of the Mura compensation data that is lost as described above.

Therefore, the general piecewise interpolation scheme has a difficulty in implementing accurate Mura compensation, due to the loss of difference values in the process of storing the Mura compensation data.

SUMMARY

Various embodiments are directed to improving the efficiency of Mura compensation using Mura compensation data by reducing the loss of a decimal part in the process of generating the Mura compensation data for Mura compensation.

Also, various embodiments are directed to correcting a compensation error by storing Mura compensation data by reducing the loss of a decimal part and performing Mura compensation using the Mura compensation data.

In an embodiment, a Mura compensation data generation apparatus for Mura compensation may include: an image representative value generation circuit configured to generate a representative value representing an entire gray of an image displayed on a display panel in correspondence to a preset gray; a difference value extraction circuit configured to extract difference values between the representative value and gray values for a plurality of preset positions on the image; a distribution range determination circuit configured to determine a distribution range of the difference values by checking a maximum value and a minimum value of the difference values; and a Mura compensation data generation circuit configured to generate Mura compensation data having a preset number of bits corresponding to the difference values, wherein when the difference values have a real value, the Mura compensation data generation circuit generates the Mura compensation data to include bits which are divided into an integer part and a decimal part in correspondence to the difference values, and configures the decimal part in the Mura compensation data to have a variable number of bits in correspondence to the distribution range.

In an embodiment, a Mura compensation apparatus of a display may include: a Mura compensation unit configured to perform Mura compensation for image data by piecewise interpolation of performing interpolation for each gray range, by using Mura compensation data of a plurality of preset planes corresponding to a gray range divided into the planes and a compensation equation; and a storage unit configured to store and provide Mura compensation data for a gray of each plane and bit number information of a decimal part, wherein the Mura compensation unit configures the decimal part of the Mura compensation data by the bit number information, and decodes the Mura compensation data having an integer part and the decimal part.

According to the embodiments of the present disclosure, since a decimal part of Mura compensation data may be changed to sufficiently express difference values between a representative value of an image and gray values of a plurality of positions on the image, the loss of the decimal part in the process of storing the Mura compensation data may be minimized.

Therefore, according to the embodiments of the present disclosure, the efficiency of Mura compensation may be improved as much as the loss of the decimal part of the Mura compensation data is minimized.

Further, according to the embodiments of the present disclosure, the Mura compensation data in which the loss of the decimal part is reduced as described above may be used for Mura compensation, and as a result, a compensation error of the Mura compensation may be corrected.

DETAILED DESCRIPTION

The present disclosure discloses a Mura compensation data generation apparatus which generates Mura compensation data to sufficiently express difference values between a representative value of an image and gray values of a plurality of positions on the image, and discloses a Mura compensation apparatus of a display using the Mura compensation data to compensate for Mura.

Figure 1:
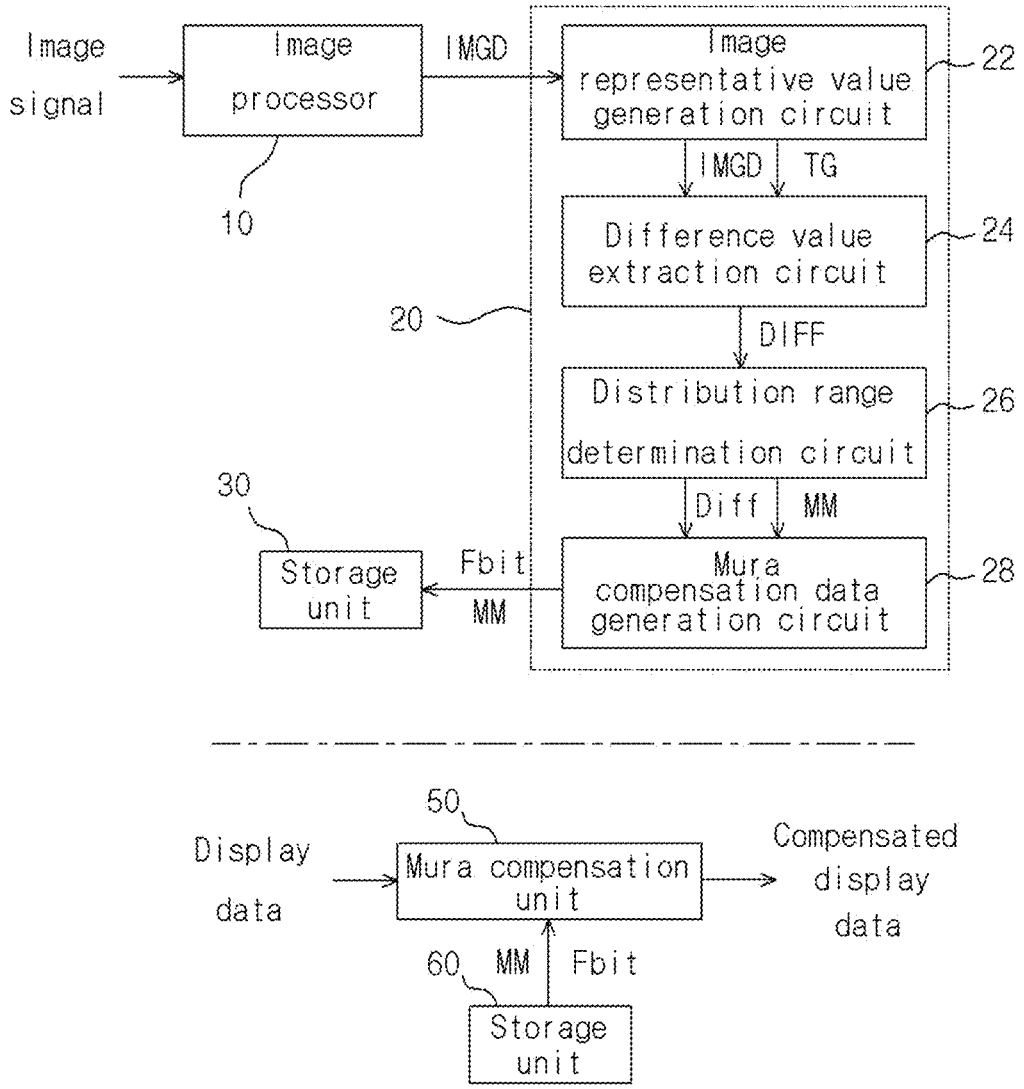
FIG. 1 is a block diagram illustrating a Mura compensation data generation apparatus and a Mura compensation apparatus of a display in accordance with embodiments of the present disclosure.

In FIG. 1, an embodiment of the Mura compensation data generation apparatus is exemplified as including an image processor 10, an encoder 20 and a storage unit 30. The Mura compensation apparatus of a display illustrated in FIG. 1 may be understood as including a Mura compensation unit 50 and a storage unit 60.

It may be understood that embodiments of the present disclosure are to perform Mura compensation in a piecewise interpolation scheme.

The Mura compensation data generation apparatus is an embodiment for generating and storing Mura compensation data for piecewise interpolation, and the Mura compensation apparatus of a display is an embodiment for performing Mura compensation by performing piecewise interpolation using the Mura compensation data.

The piecewise interpolation scheme may be used for Mura compensation of a display panel.

For the piecewise interpolation, a gray range is divided into a plurality of planes corresponding to preset grayscales, and Mura compensation data for the planes are obtained.

Figure 2:
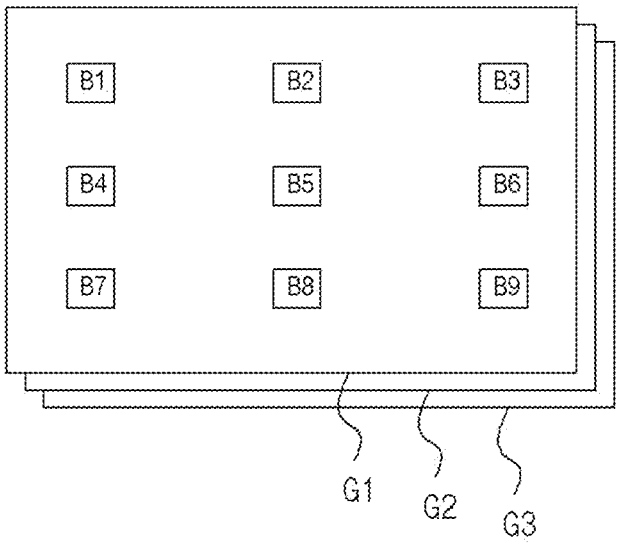
FIG. 2 is a top view illustrating images of respective grays.

To this end, images of a display panel (not illustrated), which are displayed as test data corresponding to grays of the planes, are photographed or sensed, and as a result, image signals corresponding to the planes may be generated. FIG. 2 illustrates images obtained by photographing or sensing a display panel corresponding to the grays of the planes, and images G1, G2 and G3 may be understood as images for different grays.

The images G1, G2 and G3 of FIG. 2 are images which are displayed on the display panel by the test data which are provided such that one entire image has the same gray. However, each of the images G1, G2 and G3 may include Mura, and pixels included in one image may have different gray values due to the presence of Mura.

For each of the images G1, G2 and G3, difference values of grays included in one image are encoded and stored as Mura compensation data for piecewise interpolation.

The Mura compensation data may be used for Mura compensation of the display panel.

When an image is displayed on a display panel which is mass-produced as a product, display data may be compensated using Mura compensation data. In detail, compensation values of grays corresponding to a gray range which is divided into planes may be generated by piecewise interpolation using compensation values obtained by decoding Mura compensation data of the planes which divide the corresponding range and a compensation equation of the corresponding range. The compensation equation may be exemplified as a linear equation that connects a pair of compensation values corresponding to adjacent planes. The compensation equation may be set differently for each divided range.

The compensation values of the gray range which are generated by the piecewise interpolation may be used to compensate the display data, and Mura of the display panel may be compensated for as the display data compensated in this way is provided to the display panel.

In the above description, the difference values of the grays which are generated before encoding of the Mura compensation data are generated to have various distributions, and may be expressed by integers or real numbers. However, the Mura compensation data is encoded and stored by a preset number of bits.

When the difference values of the gray have a real distribution range, the Mura compensation data should be set to have an integer part and a decimal part. According to the distribution range of the difference values, a number of bits required to express the decimal part may vary.

If a number of bits for expressing the decimal part is not allocated to the Mura compensation data, the Mura compensation data may be expressed as an integer of a value obtained by rounding the decimal part. Further, when the decimal part of the Mura compensation data has a fixed number of bits, the Mura compensation data may be expressed as a real number of a value obtained by rounding some decimals. In these cases, in the process of encoding and storing the difference values as the Mura compensation data, a part or the entirety of each of the decimal parts of the difference values is lost.

When, as described above, the Mura compensation data in which a part or the entirety of each of the decimal parts of the Mura compensation data is lost is decoded and the Mura compensation by the piecewise interpolation is performed using the encoded Mura compensation data, a compensation error may occur.

Figure 3:
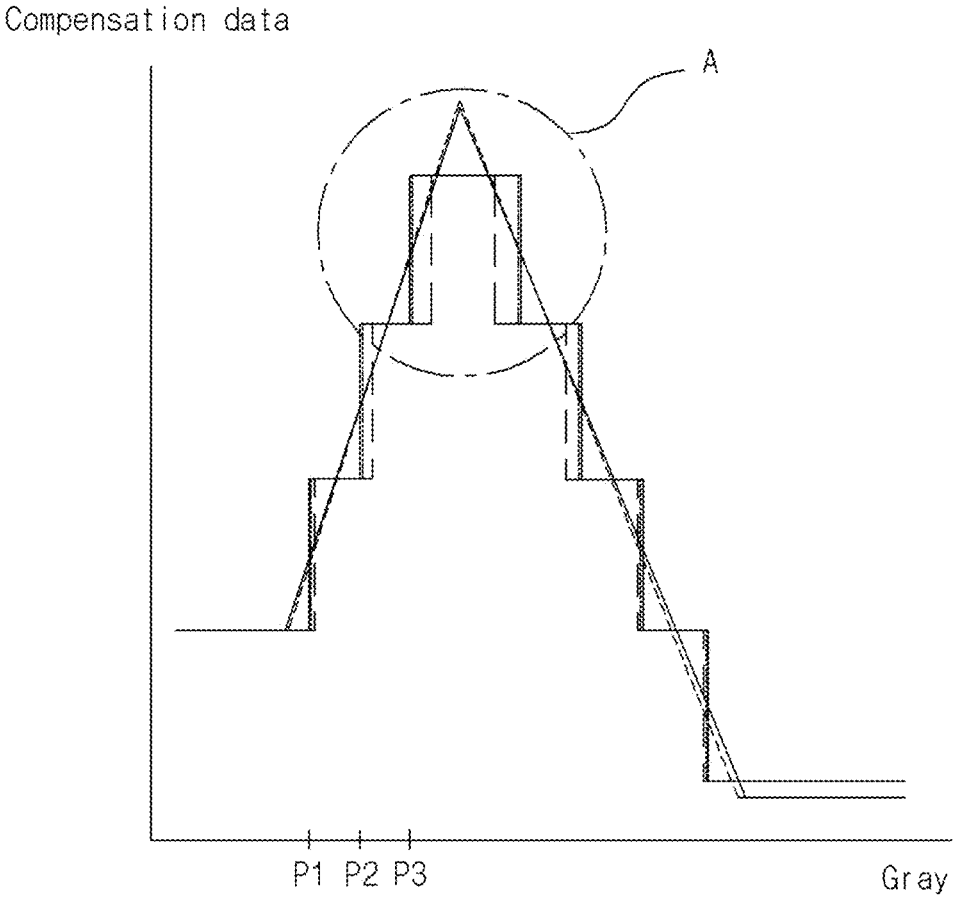
FIG. 3 is a graph for explaining a compensation error due to the loss of a decimal part.
Figure 4:
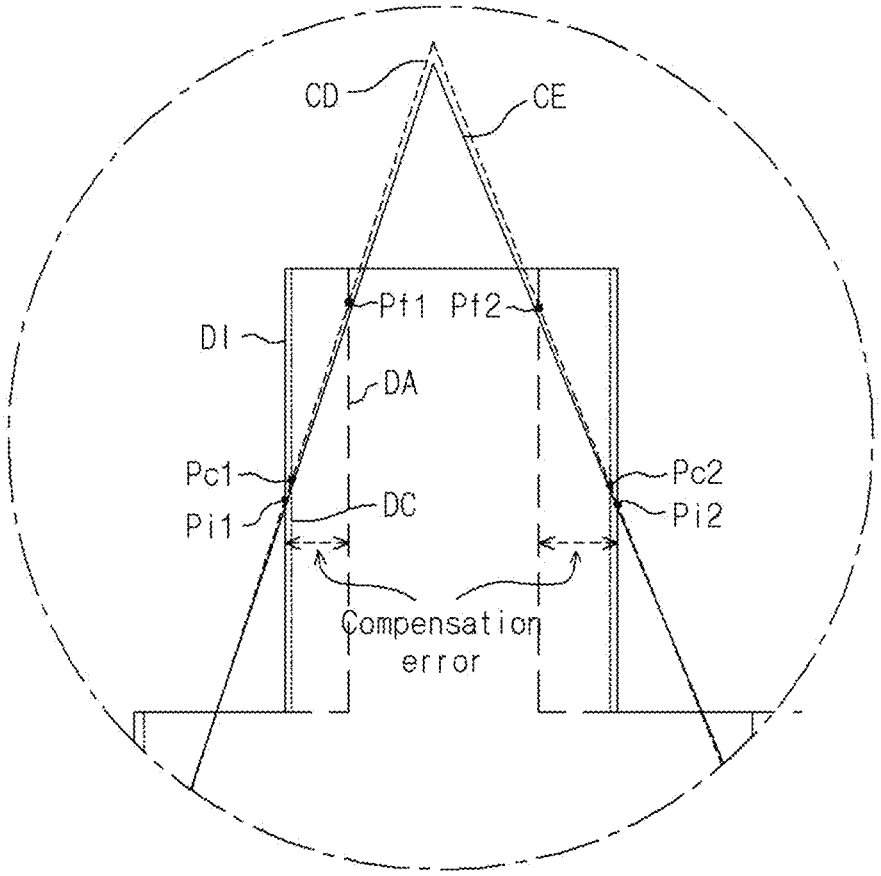
FIG. 4 is an enlarged view of a portion A of FIG. 3.

FIG. 3 is a graph showing the relationship between Mura compensation data and a gray, and FIG. 4 is an enlarged view of a portion A of FIG. 3. In FIG. 3, P1, P2 and P3 illustrate planes corresponding to the images G1, G2 and G3. In FIG. 4, CE shown by a solid line indicates difference values (before encoding), and CD shown by a broken line indicates compensation values after decoding. Pi1 and Pi2 on the solid line CE correspond to ideal compensation values when the Mura compensation data is encoded without loss, and Pf1 and Pf2 on the broken line CD correspond to compensation values when the Mura compensation data is expressed only as integers or has decimal parts having a fixed number of bits.

The present disclosure is to correct a compensation error when the Mura compensation data is encoded like Pf1 and Pf2 of FIG. 4. That is to say, in the present disclosure, by configuring Mura compensation data such that different numbers of bits for expressing a decimal part are used depending on the distribution range of difference values, it is possible to approximate to the compensation values Pi1 and Pi2 when the Mura compensation data is encoded without loss to the levels of Pc1 and Pc2 shown on the broken line CD.

To this end, the Mura compensation data generation apparatus for Mura compensation in accordance with the embodiment of the present disclosure may be implemented to include the image processor 10, the encoder 20 and the storage unit 30 as shown in FIG. 1.

First, in order to generate Mura compensation data Fbit for each plane, image data IMGD for each gray corresponding to each plane is required.

To this end, test data for expressing a gray corresponding to a plane is provided to a display panel (not illustrated), and the display panel displays an image corresponding to the test data, as illustrated in FIG. 2.

By photographing or sensing the image displayed on the display panel by using a separate photographing device or a sensing device (not illustrated), an image signal may be obtained, and the image processor 10 may receive the image signal. The image signal may be understood as an analog signal which is obtained by photographing or sensing the image.

The image processor 10 is configured to convert the analog image signal into digital image data IMGD and provide the image data IMGD to the encoder 20.

The encoder 20 is configured to extract difference values between a representative value of the image and gray values for a plurality of preset positions from the image data IMGD for a preset gray corresponding to the plane, and generate Mura compensation data according to a distribution range of the difference values.

To this end, the encoder 20 may include an image representative value generation circuit 22, a difference value extraction circuit 24, a distribution range determination circuit 26 and a Mura compensation data generation circuit 28.

The image representative value generation circuit 22 receives the image data IMGD provided from the image processor 10, and generates a representative value TG representing the entire gray of the image displayed on the display panel in correspondence to the preset gray.

The representative value TG is used as a reference value for generating difference values of grays for respective positions on the image, and may be variously generated according to the intention of a manufacturer. For example, the representative value TG may be generated by averaging the gray values of the entire image. In other words, the representative value TG may be set as an average gray value of the entire image. Alternatively, the representative value TG may be generated to have a preset value for the corresponding gray of the test data.

The image representative value generation circuit 22 may provide the image data IMGD and the representative value TG to the difference value extraction circuit 24.

The difference value extraction circuit 24 extracts difference values Diff between the representative value TG and the gray values of the image data IMGD for the plurality of preset positions.

For example, the difference value extraction circuit 24 may extract the difference values Diff by comparing gray values of a plurality of blocks at preset positions such as a plurality of blocks B1 to B9 of FIG. 2 with the representative value TG. The gray value of each block may be understood as an average gray value of at least one pixel included in the block.

The difference values Diff extracted for the blocks by the difference value extraction circuit 24 are provided to the distribution range determination circuit 26.

The distribution range determination circuit 26 determines a distribution range of the difference values Diff by checking a maximum value and a minimum value of the difference values Diff.

Figure 5:
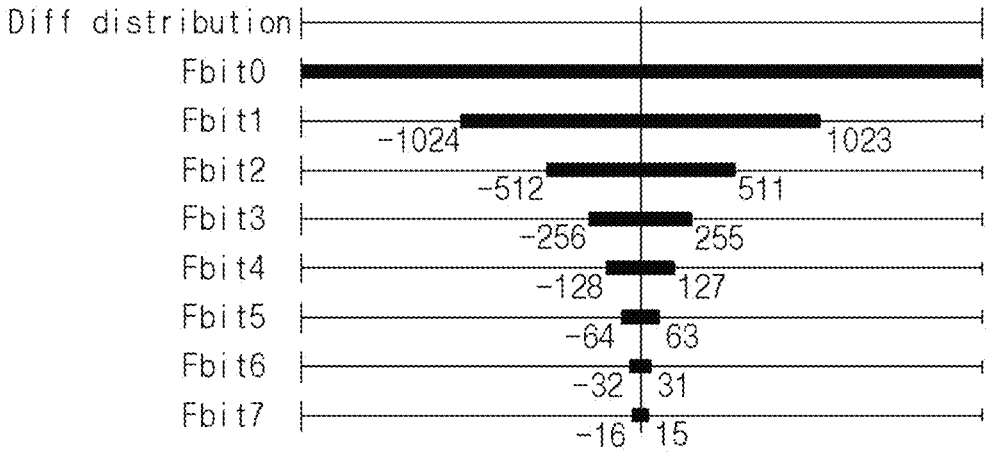
FIG. 5 is a diagram illustrating difference value distribution ranges.

A plurality of distribution ranges may be defined in the distribution range determination circuit 26 as shown in FIG. 5.

For example, a distribution range may be defined as Fbit0 when difference values between the representative value and the gray are out of −1024 and 1023, a distribution range may be defined as Fbit1 when difference values between the representative value and the gray are included between −1024 and 1023, a distribution range may be defined as Fbit2 when difference values between the representative value and the gray are included between −512 and 511, a distribution range may be defined as Fbit3 when difference values between the representative value and the gray are included between −256 and 255, a distribution range may be defined as Fbit4 when difference values between the representative value and the gray are included between −128 and 127, a distribution range may be defined as Fbit5 when difference values between the representative value and the gray are included between −64 and 63, a distribution range may be defined as Fbit6 when difference values between the representative value and the gray are included between −32 and 31, and a distribution range may be defined as Fbit7 when difference values between the representative value and the gray are included between −16 and 15. The above-described difference values may be understood as decimal numbers for example.

Also, for example, the distribution range Fbit0 may not define a decimal part in Mura compensation data, the distribution range Fbit1 may define a decimal part as one bit in Mura compensation data, the distribution range Fbit2 may define a decimal part as two bits in Mura compensation data, the distribution range Fbit3 may define a decimal part as three bits in Mura compensation data, the distribution range Fbit4 may define a decimal part as four bits in Mura compensation data, the distribution range Fbit5 may define a decimal part as five bits in Mura compensation data, the distribution range Fbit6 may define a decimal part as six bits in Mura compensation data, and the distribution range Fbit7 may define a decimal part as seven bits in Mura compensation data.

Accordingly, the distribution range determination circuit 26 may determine a distribution range being a smallest range in which both a maximum value and a minimum value are included, as a distribution range corresponding to difference values, and may provide the difference values Diff and bit number information MM of the corresponding distribution range to the Mura compensation data generation circuit 28.

Figure 6:
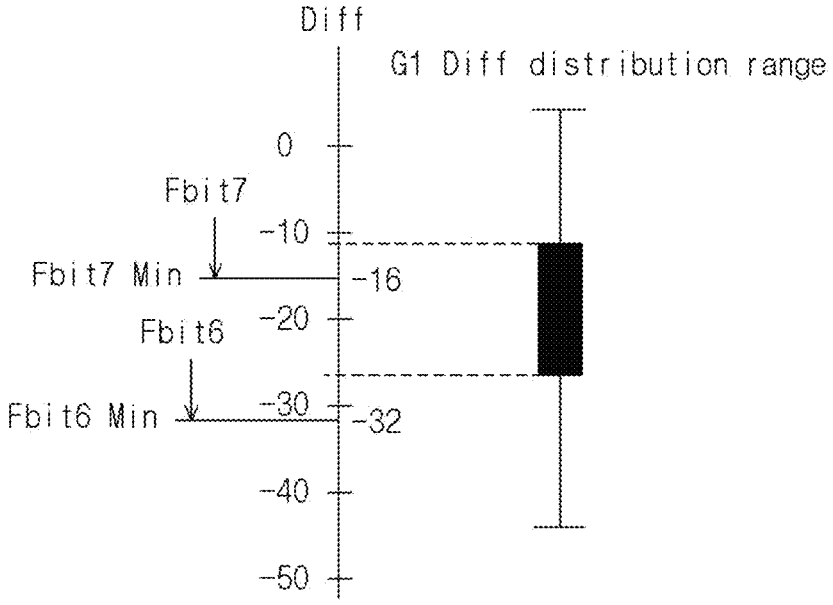
FIG. 6 is a diagram for explaining a method of determining a distribution range of a difference value.

Referring to FIG. 6, for example, when the difference values Diff are distributed in a range of −11 to −27, it may be defined that the difference values Diff correspond to the distribution range Fbit6 being a smallest range in which both a maximum value and a minimum value are included.

The Mura compensation data generation circuit 28 receives the difference values Diff and the bit number information MM of the decimal part of the corresponding distribution range, and generates compensation data Fbit of a preset number of bits corresponding to the difference values Diff.

The Mura compensation data generation circuit 28 may configure the Mura compensation data Fbit only as an integer part when the difference values Diff correspond to the distribution range Fbit0. When 10 bits are allocated to the configuration of the Mura compensation data Fbit, the entirety of 10 bits of the Mura compensation data Fbit may be configured as an integer part.

When the difference values Diff have a real value and thus correspond to any one of the distribution ranges Fbit1 to Fbit7, the Mura compensation data generation circuit 28 may generate the Mura compensation data Fbit to include bits divided into an integer part and a decimal part in correspondence to the difference values Diff, and may configure the decimal part of a variable number of bits corresponding to the distribution range, in the Mura compensation data Fbit.

For example, when the difference values Diff correspond to the distribution range Fbit6, the Mura compensation data generation circuit 28 may configure six bits among the 10 bits allocated to the configuration of the Mura compensation data Fbit, as the decimal part. When the difference values Diff correspond to the distribution range Fbit4, the Mura compensation data generation circuit 28 may configure four bits among the 10 bits allocated to the configuration of the Mura compensation data Fbit, as the decimal part.

Namely, in the embodiment of the present disclosure, the Mura compensation data Fbit may be configured to have a decimal part of a number of bits capable of maximally expressing a decimal, in consideration of a distribution range of the difference values Diff, within a limited bit number range.

Therefore, the embodiment of the present disclosure may minimize the loss of a decimal part in the process of encoding the Mura compensation data Fbit.

The storage unit 30 may receive and store the Mura compensation data Fbit and the bit number information MM of a decimal part for a gray, which are provided from the Mura compensation data generation circuit 28. The bit number information MM of a decimal part may be used to identify the number of bits of the decimal part when decoding the Mura compensation data Fbit.

The Mura compensation data Fbit generated by the above-described Mura compensation data generation apparatus in accordance with the embodiment of the present disclosure may be used in piecewise interpolation for Mura compensation of a display panel mass-produced as a product.

As described above, the Mura compensation unit 50 and the storage unit 60 of FIG. 1 show an embodiment of a Mura compensation apparatus of a display.

It may be understood that the storage unit 60 stores the Mura compensation data Fbit and the bit number information MM of a decimal part stored in the storage unit 30 included in the embodiment of the Mura compensation data generation apparatus.

The Mura compensation unit 50 may be configured in an integrated circuit which processes display data to be provided to a display panel in a display device. The integrated circuit may be a driving circuit (not illustrated) which receives display data and provides a source signal to the display panel, or a timing controller (not illustrated) which provides display data to the driving circuit.

The storage unit 60 may be configured inside or outside the integrated circuit according to the intention of a manufacturer.

The Mura compensation unit 50 may receive display data, and the Mura compensation data Fbit and the bit number information MM of a decimal part of the storage unit 60.

The Mura compensation unit 50 may generate compensation values of grays corresponding to a gray range which is divided into planes, by piecewise interpolation using compensation values obtained by decoding the Mura compensation data Fbit of the planes which divide the corresponding range and a compensation equation of the corresponding range.

The Mura compensation unit 50 may use the compensation values of the gray range generated by the piecewise interpolation, to compensate display data, and Mura of the display panel may be compensated for by the compensated display data.

The Mura compensation unit 50 decodes Mura compensation data to have a decimal part having a number of bits corresponding to the bit number information MM of a decimal part.

The decoded Mura compensation data minimizes the loss of a decimal part during the encoding process. Therefore, in the present disclosure, a compensation value may be generated at a level close to difference values, and a compensation error may be corrected accordingly.

Therefore, the present disclosure has an advantage of being able to efficiently perform Mura compensation for an image to be displayed on a display panel.

What is claimed is:

1. A Mura compensation data generation apparatus for Mura compensation, comprising:

an image representative value generation circuit configured to generate a representative value representing an entire gray of an image displayed on a display panel in correspondence to a preset gray;

a difference value extraction circuit configured to extract difference values between the representative value and gray values for a plurality of preset positions on the image;

a distribution range determination circuit configured to determine a distribution range of the difference values by checking a maximum value and a minimum value of the difference values; and a Mura compensation data generation circuit configured to generate Mura compensation data having a preset number of bits corresponding to the difference values, wherein when the difference values have a real value, the Mura compensation data generation circuit generates the Mura compensation data to include bits which are divided into an integer part and a decimal part in correspondence to the difference values, and configures the decimal part in the Mura compensation data to have a variable number of bits in correspondence to the distribution range.

2. The Mura compensation data generation apparatus according to claim 1, further comprising:

a memory configured to store the Mura compensation data for the gray and bit number information of the decimal part, wherein the Mura compensation data generation circuit provides the Mura compensation data for the gray and the bit number information of the decimal part.

3. The Mura compensation data generation apparatus according to claim 1, wherein the image representative value generation circuit receives image data of the image, and generates an average gray value of the entire image as the representative value.

4. The Mura compensation data generation apparatus according to claim 1, wherein the image representative value generation circuit generates the representative value as a preset value for the gray.

5. The Mura compensation data generation apparatus according to claim 1, wherein the difference value extraction circuit extracts the difference values by comparing gray values of a plurality of blocks at preset positions on the image with the representative value.

6. The Mura compensation data generation apparatus according to claim 5, wherein the difference value extraction circuit extracts the difference values by comparing average gray values of the blocks each including at least one pixel with the representative value.

7. The Mura compensation data generation apparatus according to claim 1, wherein a plurality of distribution ranges are defined in the distribution range determination circuit, and the distribution range determination circuit determines, among the plurality of distribution ranges, a smallest distribution range in which both the maximum value and the minimum value are included, as a distribution range corresponding to the difference values.

8. The Mura compensation data generation apparatus according to claim 7, wherein the distribution range determination circuit provides the difference values and the bit number information of the decimal part of the distribution range corresponding to the difference values, to the Mura compensation data generation circuit.

9. The Mura compensation data generation apparatus according to claim 1, wherein the Mura compensation data generation circuit receives the difference values and the bit number information of the decimal part of the distribution range, and generates the Mura compensation data including the decimal part having a number of bits, corresponding to the bit number information, and corresponding to the difference values.

10. A Mura compensation apparatus of a display, comprising:

a Mura compensation unit configured to perform Mura compensation for image data by piecewise interpolation of performing interpolation for each gray range, by using Mura compensation data of a plurality of preset planes corresponding to a gray range divided into the planes and a compensation equation; and a storage unit configured to store and provide Mura compensation data for a gray of each plane and bit number information of a decimal part, wherein the Mura compensation unit configures the decimal part of the Mura compensation data by the bit number information, and decodes the Mura compensation data having an integer part and the decimal part.

11. The Mura compensation apparatus according to claim 10, wherein the storage unit stores bit number information of a decimal part which is variable for each plane.

* * * * *